US005304034A

United States Patent [19]

Bouwman

[11] Patent Number: 5,304,034

[45] Date of Patent: Apr. 19, 1994

[54] METHOD FOR CONSTRUCTING A PUMPING INSTALLATION

[75] Inventor: Matheus A. M. Bouwman, Hengelo, Netherlands

[73] Assignee: Stork Pompen B.V., Hengelo, Netherlands

[21] Appl. No.: 840,582

[22] Filed: Feb. 24, 1992

Related U.S. Application Data

[63] Continuation of Ser. No. 473,406, Feb. 1, 1990, abandoned.

[30] Foreign Application Priority Data

Feb. 2, 1989 [NL] Netherlands ..... 8900260

[51] Int. Cl.[5] ..... F01D 25/24

[52] U.S. Cl. ..... 415/214.1; 415/200; 417/423.14; 52/582.1

[58] Field of Search ..... 415/200, 214.1, 213.1; 417/423.14; 52/21, 224, 583

[56] References Cited

U.S. PATENT DOCUMENTS

| | | | |
|---|---|---|---|
| 1,283,288 | 10/1918 | Pfau | 415/200 |
| 1,934,636 | 11/1933 | Martin | 415/182.1 |
| 2,897,375 | 7/1959 | Fevre | 415/200 |
| 4,869,643 | 9/1989 | de Vries | 415/200 |

FOREIGN PATENT DOCUMENTS 2555253 2/1977 Fed. Rep. of Germany .

*Primary Examiner*—John T. Kwon

*Attorney, Agent, or Firm*—Webb, Burden, Ziesenheim & Webb

[57] ABSTRACT

The disclosure discloses a method for constructing a pumping installation which includes a prefabricated concrete pump house and a prefabricated concrete suction box. The pump house and suction box are then placed on and coupled to a workfloor manufactured at the building site. A pump is then installed in the pump house.

7 Claims, 6 Drawing Sheets

METHOD FOR CONSTRUCTING A PUMPING INSTALLATION

Figure 1:
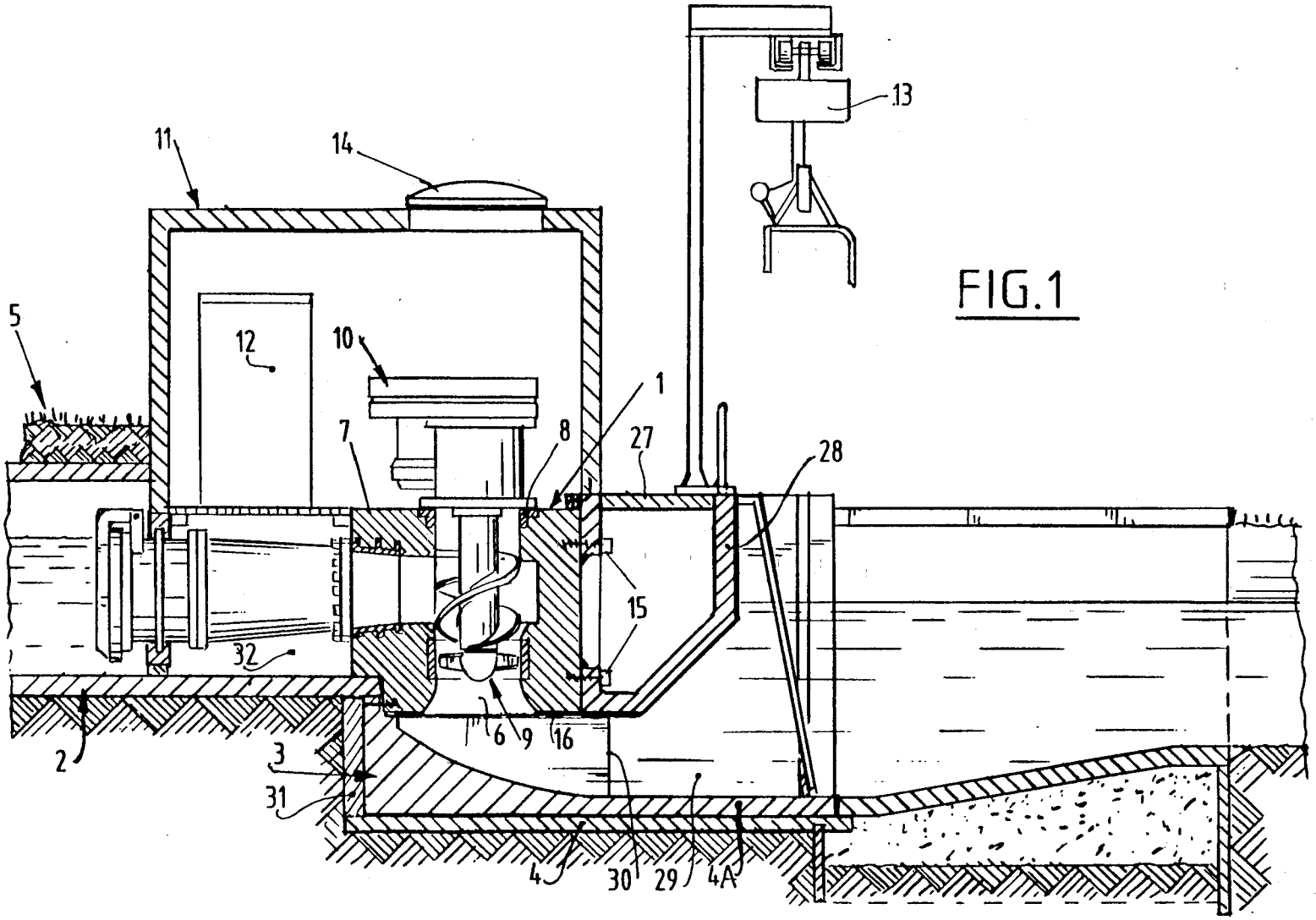

This is a continuation of copending application Ser. No. 07/473,406 filed on Feb. 1, 1990, now abandoned.

Pumping installations, particularly as used in pumping stations in open country, should require the least possible degree of maintenance. Furthermore, it is important that as little installation work as possible need be carried out at the place of use. To this end it has already been proposed that pumps, or at least the pump house and the adjoining parts, be manufactured from concrete. This is preferably carried out in a prefabricated construction method wherein the pump house amongst other things is manufactured in concrete portions which are attached to each other at the place of use. Although this is a considerable improvement compared to the classical method, that is, the complete manufacture at the place of use of the housing of both the pump and the remaining parts of the installation, the number of operations to be performed at the place of use was still undesirably large. Another drawback is that the flexibility of design is not optimal. The aim is to provide a pumping installation which can be modularly constructed, which ensures a great degree of flexibility and requires a minimum number of operations at the building site itself.

According to the invention this is achieved with a method for constructing a pumping installation by manufacturing from concrete in a prefabricated manner and with chosen dimensions a pump block comprising at least one pump house and a suction box, manufacturing a workfloor at the building site and by then placing and coupling on the workfloor the suction box and the pump house and subsequently installing the pump.

On the building site it will suffice according to the invention to carry out the ground work, to manufacture a workfloor from concrete or other foundation material such as slag material, gravel and the like and thereafter to place as desired the prefabricated modules, for example with a hoisting device, and finally to install the pump itself, that is, the drive mechanism and the impeller part. With a pump block according to the invention a very high degree of protection against corrosion is achieved which can in addition be easily integrated into the whole pumping or draining installation and imposes no restrictions on the architect designing an optional superstructure. Because the installation is modularly constructed, different dimensions can be chosen for each of the modules, namely the pump house and the suction box, subject to the requirements at the place of use.

A pump house provided with a volute can be manufactured by fitting a casing consisting of separate portions, casting the concrete and removing portions of the casing, for example those of the volute, while the other portions remain behind as permanent casing. The casing portions are of metal.

In order to be able to remove the casing portions from the finished pump block the casing wall of the pump house is constructed in a vertical direction from at least three portions. After the casting and setting of the concrete these portions are detached and removed successively in vertical direction. The casing wall of the volute can be assembled from at least three portions. After casting and setting of the concrete these portions are detached from the remaining casing and removed to the inside, that is, towards the pump area.

For pouring the concrete of the pump house the bottom side is closed off with a casing wall. After removal of the casing the distance corresponding with the thickness of the bottom wall of the casing has to be bridged in order to be able to centre the pump block on the remaining portions. In practice this can be done with plastic plates the thickness of the casing wall.

The invention will be further elucidated with reference to the drawings.

Figure 2:
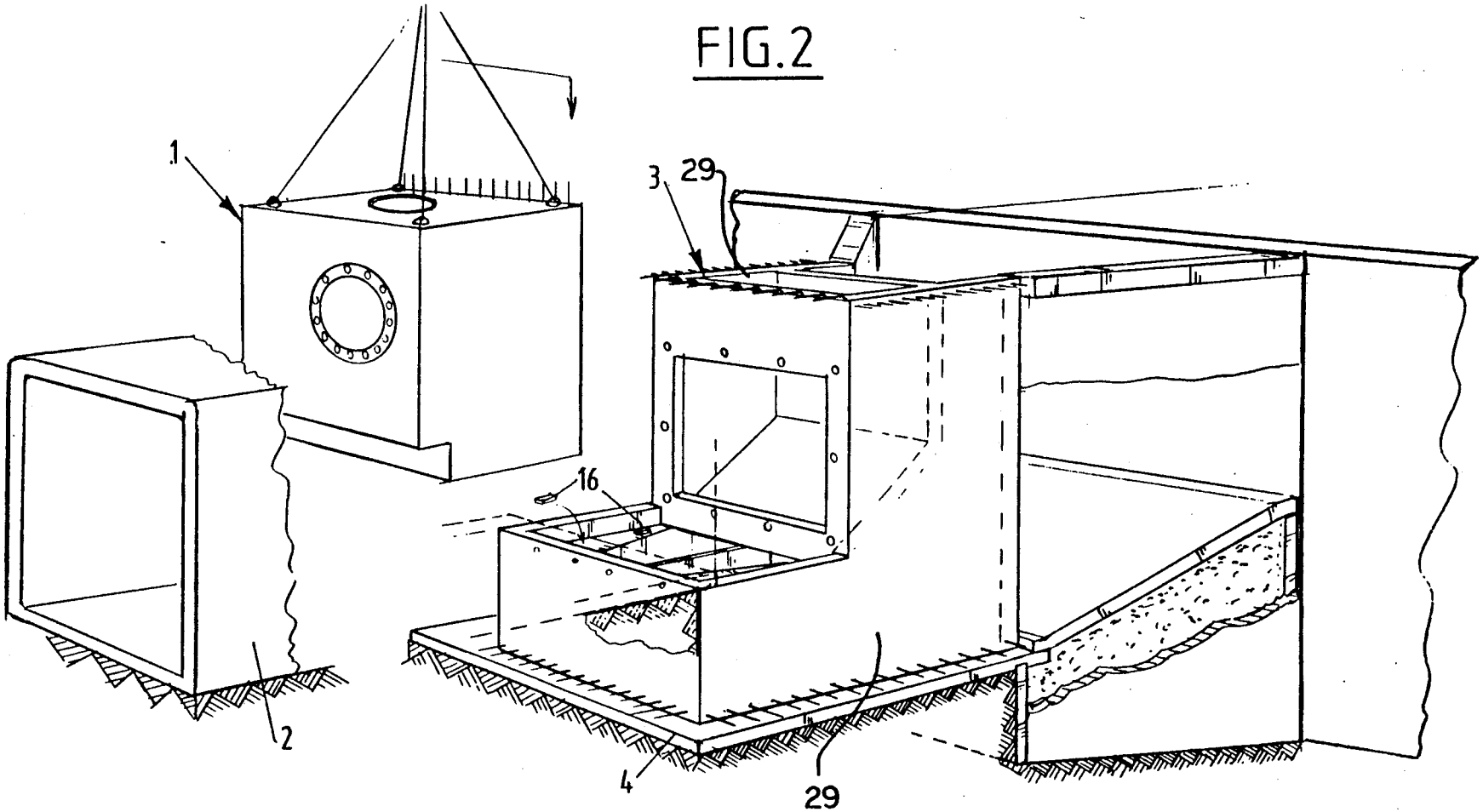
Figure 3:
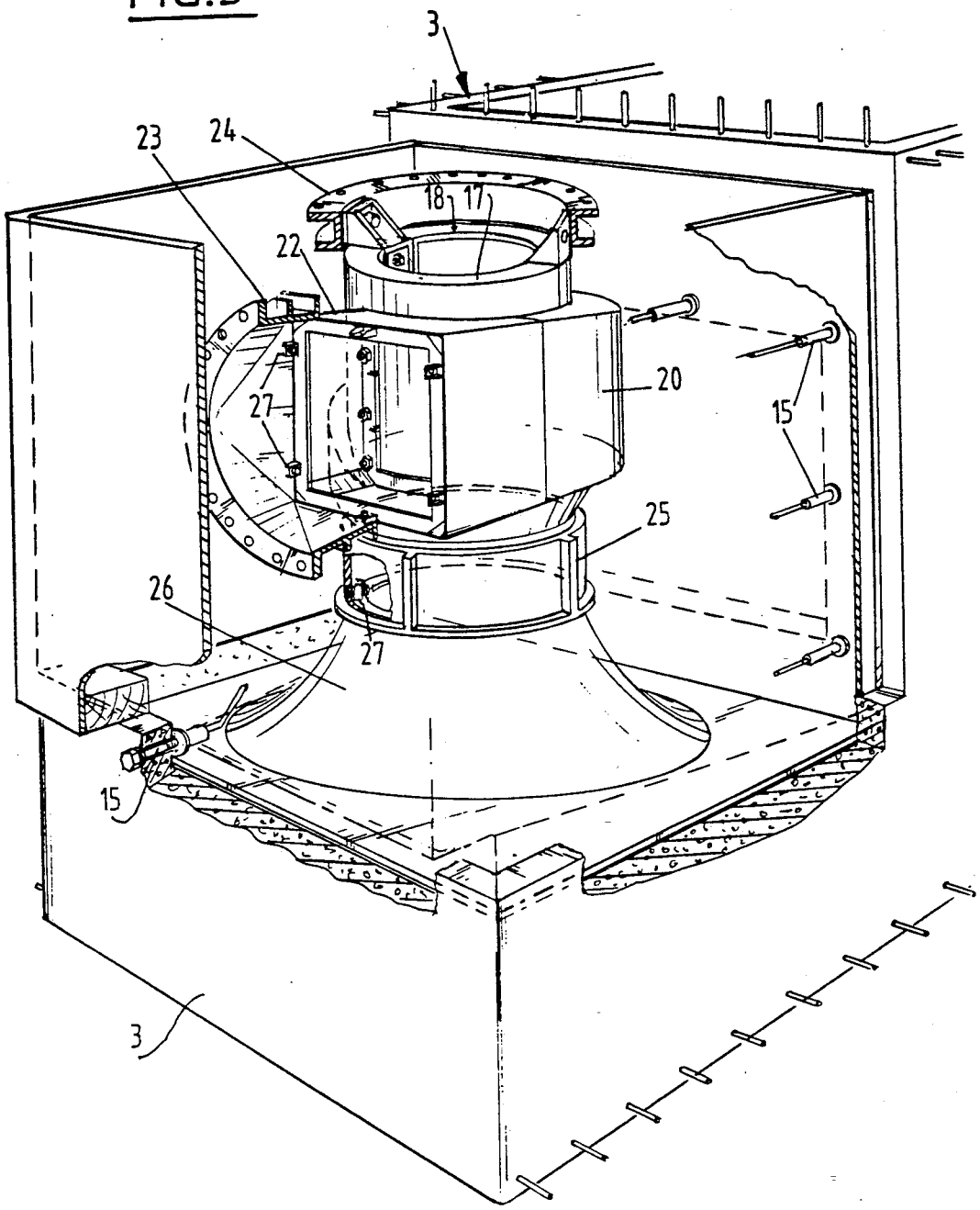
Figure 4:
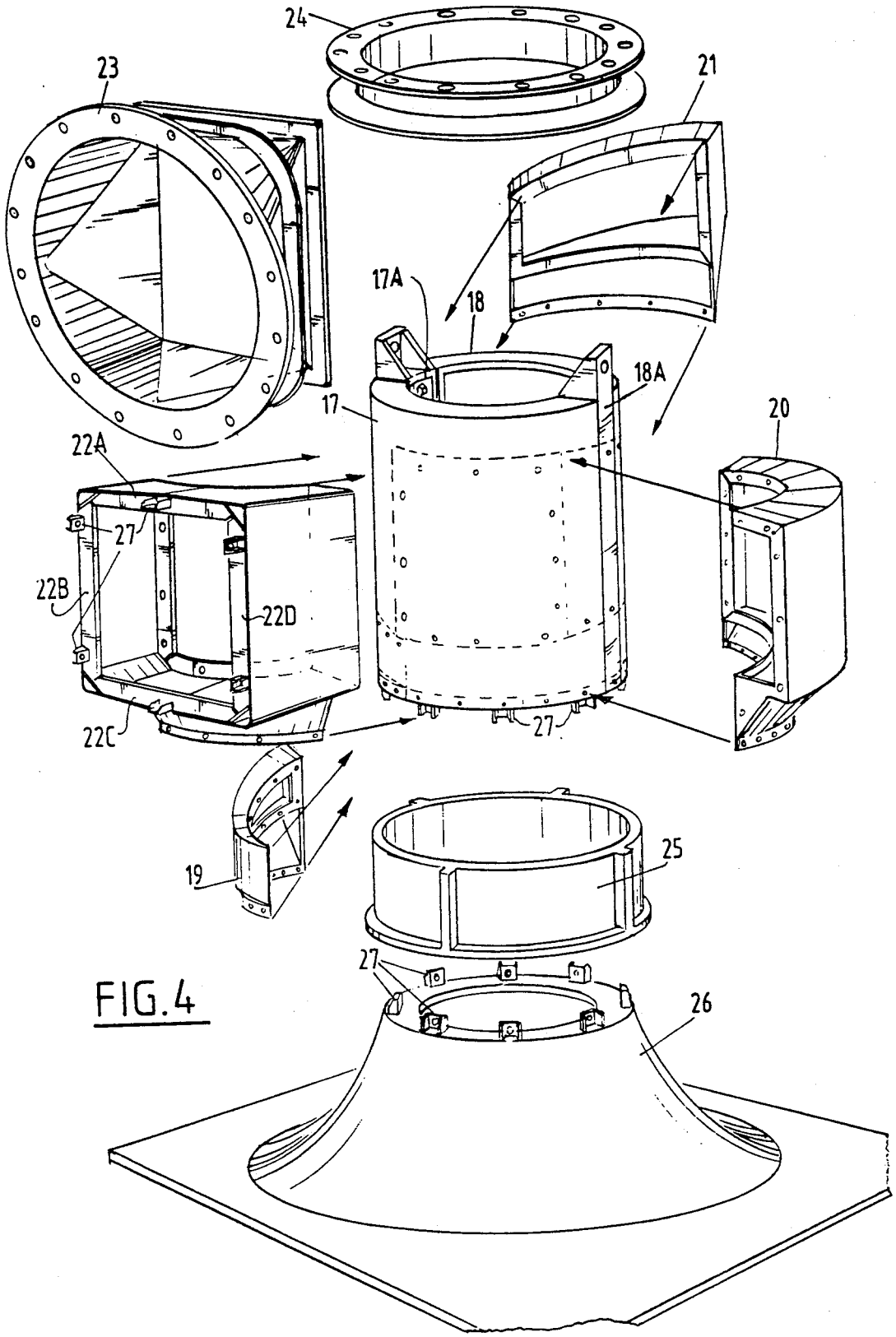
Figure 5:
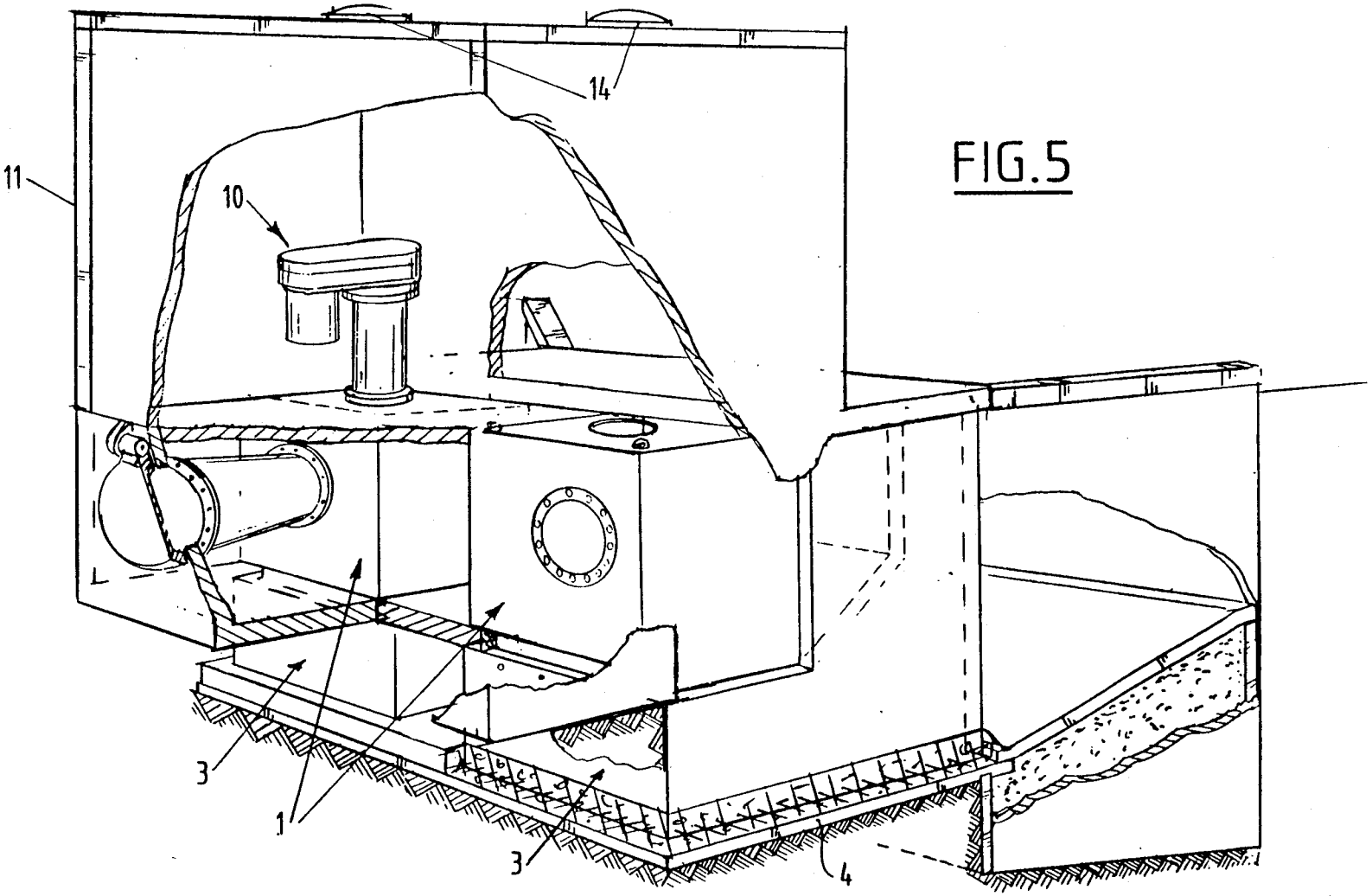
Figure 6:
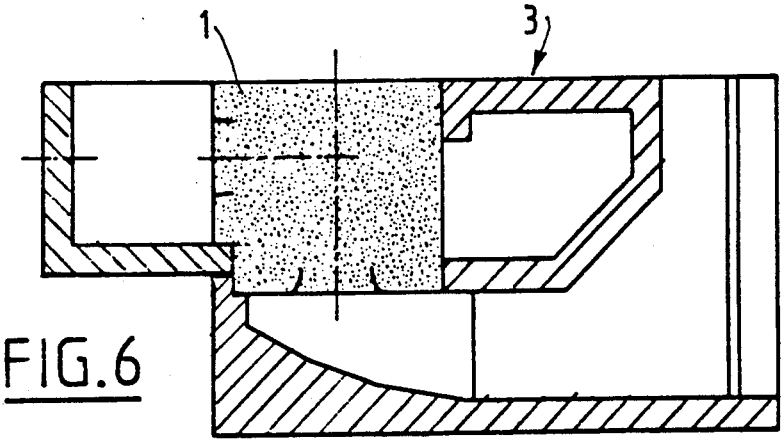
Figure 7:
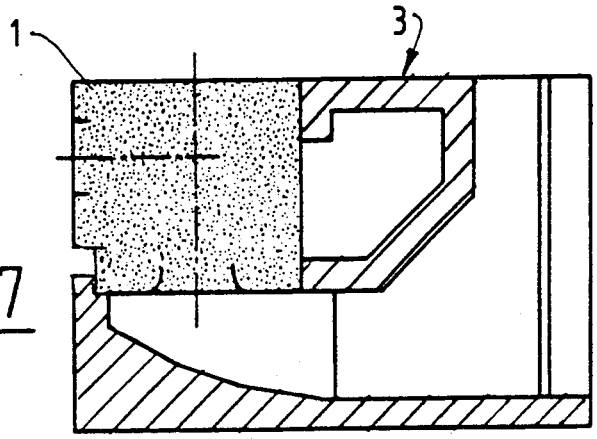
Figure 8:
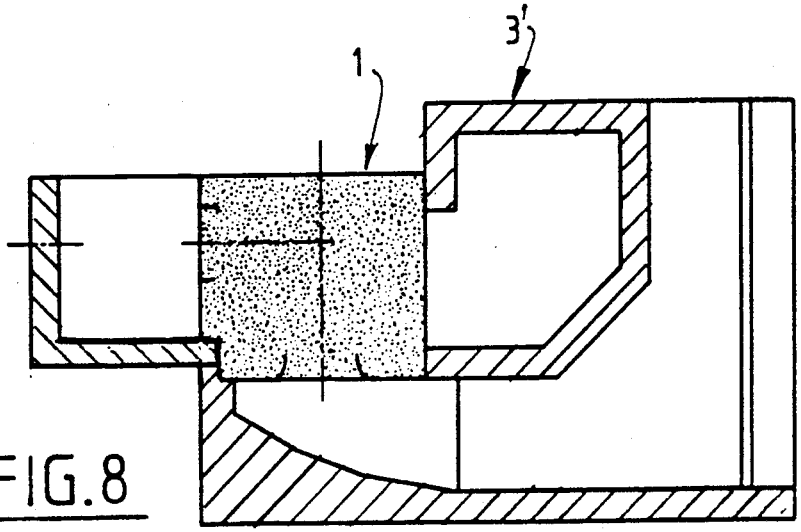

FIG. 1 shows a cross sectional view through a pumping installation according to the invention, FIG. 2 shows the modules of the installation according to FIG. 1 in dismantled state, FIG. 3 shows a perspective view of the pump block, FIG. 4 shows the different casing portions in dismantled state, FIG. 5 shows the pumping installation in assembled state, and FIG. 6, 7 and 8 show different possible combinations of the modules of the pumping installation.

The pumping installation is built up of the pump block 1, the culvert body 2, the accessories area 32 and the suction box 3. The different modules are disposed on a workfloor 4 which is manufactured in the work. The whole is built into for example the body of a dike 5.

The pump block contains the pump area 6 which is bounded by the pump house 7. The actual pump, that is, the impeller body 9 and the associated drive motor 10, are mounted on a foundation ring 8 which is cast into the concrete of the housing 7. In the surrounding housing 11 can be arranged a control box 12 with signalling units, control units and power supply. Next to the housing can be disposed a duckweed grating cleaning installation 13.

The FIGS. 6, 7 and 8 show different possible combinations of the installation formed from modules.

The different modules are anchored to each other using bolts and cast-in screwed sleeves (see for instance FIG. 3) 15. For the desired height adjustment plastic plates 16 can be used which are placed under the pump block in order to enable centering on the suction box.

For manufacturing the pump house use is made of a casing consisting of portions. The casing for the cylindrical pump area consists of four portions 17, 17A, 18, 18A which are mutually connected in lengthwise direction. Arranged around this casing 17, 17A, 18, 18A are three casing portions for the volute 19, 20 and 21. Also arranged are the casing 22A, 22B, 22C and 22D and discharging 23 for the discharge as well as an annular portion 24 serving as foundation ring. This foundation ring can be cast directly into the pump house or arranged later in the finished pump house and cast into a recess. The underside of the pump block is bounded by the portions 25 and 26 which can be coupled by the elements 27. Of the drawn portions, the portions 23, 24 and 25 are portions which are to be regarded as permanent casing. These remain behind cast in the concrete. On the other hand, the portions 17, 17A, 18, 18A, 19, 20, 21, 22A, 22B, 22C and 22D and 26 are removed after the setting of the concrete. To this end the portions 17A and 18A are first detached and successively removed in vertical direction. After detaching of the portions 19, 20 and 21 these are removed one by one inward to the pump area and subsequently in vertical direction. The portion 22 then follows which is taken out via the pump area and subsequently in vertical direction. Finally, the portion 26 is removed in downward direction. After manufacture of the separate modules these can be carried using normal transportation, for example a truck, trailer or the like, to the place of use and there arranged on the intended location with simple hoisting devices.

It is noted that the suction box 3 (FIG. 1) can be modularly constructed. A cover plate 27, a guiding plate 28, both side plates, whereof one 29 is visible, an anti-rotation partition 30, the end plate 31 and bottom plate 4A are then prefabricated. These portions are then assembled on the building site.

It is also possible to construct other added elements modularly. This applies for example to the accessories area 32.

I claim:

1. A method for constructing a pumping installation at a building site having a prefabricated pump lock with chosen dimensions, comprising the steps of:

(a) manufacturing a plurality of prefabricated modules at a site other than the building site, said modules including a pump house and a suction box wherein manufacturing of the pump house comprises the following steps:

forming a cylindrical casing for the pump area;

forming a volute casing around said cylindrical casing;

forming a discharge casing;

attaching an annular discharge ring to said discharge casing;

attaching an underside casing to a bottom portion of said cylindrical casing;

casting concrete around said casings;

removing said cylindrical casing in the vertical direction after the setting of said concrete defining a cylindrical passageway;

removing said volute casing inwardly and then vertically through the cylindrical passageway; and removing the bottom section downwardly;

(b) attaching a foundation ring to the pump house;

(c) transporting said modules to said building site;

(d) manufacturing a workfloor on a building site;

(e) placing said modules on said workfloor;

(f) coupling said modules to said workfloor; and (g) installing a pump to said pump house.

2. The method of claim 1 further comprising the step of attaching said modules to each other by bolts and cast-in screw sleeves.

3. The method of claim 1 further comprising the step of centering the suction box relative to the pump block.

4. The method of claim 3 wherein plates are placed under said pump block to center said suction box.

5. The method of claim 4 wherein said plates are made of plastic.

6. The method of claim 1 wherein said cylindrical casing is formed by a plurality of portions connected in a lengthwise direction.

7. The method of claim 1 wherein said volute casing is formed by arranging a plurality of volute casing portions around said cylindrical casing and after the concrete has set removing said volute casing portions inwardly and vertically through the cylindrical passageway.

* * * * *